US006935228B2

(12) United States Patent
Brandtjen, Jr. et al.

(10) Patent No.: US 6,935,228 B2
(45) Date of Patent: Aug. 30, 2005

(54) PLATEN PRESS

(75) Inventors: Henry A Brandtjen, Jr., St. Paul, MN (US); Kenneth Rinard, Forest Lake, MN (US); Robert W. Palmer, Scandia, MN (US)

(73) Assignee: Brandtjen & Kluge, Inc., St. Croix Falls, WI (US)

( * ) Notice: Subject to any disclaimer, the term of this patent is extended or adjusted under 35 U.S.C. 154(b) by 0 days.

(21) Appl. No.: 09/844,310

(22) Filed: Apr. 27, 2001

(65) Prior Publication Data

US 2001/0047728 A1 Dec. 6, 2001

Related U.S. Application Data

(63) Continuation of application No. 09/573,095, filed on May 17, 2000.

(51) Int. Cl.[7] ..... B30B 7/00; B30B 1/06

(52) U.S. Cl. ..... 100/233; 100/265; 100/280

(58) Field of Search ..... 100/219, 233, 100/280, 281, 243, 269.01, 270, 265, 266; 156/580, 581, 583.1, 583.8

(56) References Cited

U.S. PATENT DOCUMENTS 2,644,151 A * 6/1953 Krueger ..... 100/99
3,450,031 A * 6/1969 Peterson ..... 100/326
3,979,148 A * 9/1976 Martin ..... 295/215
4,416,198 A * 11/1983 Rasenberger ..... 101/3.1
5,147,496 A * 9/1992 Hix ..... 156/583.8
5,167,750 A * 12/1992 Myers ..... 156/583.9
D340,730 S * 10/1993 Myers ..... D15/146
5,474,633 A * 12/1995 Myers ..... 156/230
H1623 H * 1/1997 Reed et al. ..... 219/524
5,997,453 A * 12/1999 Weidhaas et al. ..... 483/28

OTHER PUBLICATIONS

Brochure, "Foil Stamping, Embossing & Die Cutting Press", *Brandtjen & Kluge, Inc.*, 4 pgs, (date unknown).

Brochure, "Hydraulic Presses", *Industrial Tool & Machine Service Company Inc.*, 2 pgs., (date unknown).

* cited by examiner

*Primary Examiner*—Derris H. Banks
*Assistant Examiner*—Shelley Self
(74) *Attorney, Agent, or Firm*—Merchant & Gould P.C.

(57) ABSTRACT

A method and an apparatus for varying the dwell parameters for a platen press are disclosed. The method involves creating an impression force between first and second platens using a driven biasing member where movement of the member is controlled by a tensioner. The apparatus includes a driven biasing member that is linked to at least one of the first and second platens that form the press and a tensioner linked to the biasing member. The bias and tensioner permit the dwell time to be extended and allows the impression force between the platens to be variably applied.

21 Claims, 2 Drawing Sheets

PLATEN PRESS

RELATED APPLICATIONS

This application is a continuation of the application entitled IMPROVED PLATEN PRESS, Ser. No. 09/573,095, filed on May 17, 2000.

TECHNICAL FIELD

This invention relates to platen presses used in foil stamping, embossing, die cutting, and for other purposes. More specifically, this invention relates to improving the flexibility of the platen press implementing a tensioner in conjunction with a driven biasing member.

BACKGROUND

Platen presses perform foil stamping, embossing, or die cutting by compressing a target material between two platens. The target material is placed between the platens while they are separated. Then, a driving force is applied to at least one of the platens to force the platens together. Most implementations of platen presses require that the force between the contacted platens be relatively great. Pressure approaching 2000 pounds per square inch of image is often applied when foil stamping.

To provide such compression forces repeatedly and quickly, a driving mechanism, which is often a crank, is used to drive an arm that moves one of the platens back and forth due to the movement of the driving mechanism. The faster the driving mechanism moves, the greater the frequency of the compressions. A loading mechanism is usually employed to remove the previously stamped material from between the platens and then place new target material therebetween during each compression cycle while the platens are separated.

A glider is typically provided in the arm so that the movable platen and the arm are not rigidly connected. The glider is able to slide along the arm as needed during the impression cycle. In use, the driving mechanism causes the arm to move the platen. In platen presses that use a crank as a driving mechanism, when the crank is at a 0° or initial position, the arm holds the platens in an open position. As the crank rotates toward a 180° position or half a revolution, it pulls the platens together and creates pressure between them.

Springs are used with the glider to provide a longer dwell by allowing the platens to establish contact sooner. One end of the springs is connected to the arm and the other end connects to the glider. When the platens first come into contact, the glider is forced to slide in the direction opposing the biasing force provided by the springs due to the continued movement of the connecting arm. Until rotation of the crank approaches 180° and the arm reaches its maximum distance of travel, the compression force is provided primarily by the springs. This force is only about 1000 pounds which produces pressure well short of the 1 ton per square inch of image pressure that is often necessary.

As the crank continues to turn toward the 180° position, the springs compress and the force remains in the 1000 pound range. Finally, the crank reaches a 180° position or a half revolution and the compression force approaches the tensile strength of the arm connected to the crank due to the springs becoming fully compressed. This force approaches 45 tons for medium sized platen presses. However, the 45 tons of force is only an impulse and is not sustained. As soon as the force has peaked, the crank continues to turn, and the compression force falls back to the compression force provided by the springs until the platens separate.

Platen presses that employ springs to extend the dwell suffer from a lack of flexibility. To alter the impression force so that the springs do not contribute to extend the dwell, the springs must either be removed (and the platen's position adjusted) and replaced with spacer bushings that lock the glider in place or the springs must be locked in place. If the contribution by the springs needs to be altered but not entirely eliminated, the springs must be replaced with springs of a different force.

Furthermore, if a rigid non-extended dwell system is desired and the springs are not removed, the springs must be locked in their extended position by a mechanical blocking device such as a spacer bushing that fits between the springs and locks the glider in place. Inserting the spacer bushing effectively blocks out the springs, and this block out requires that the platen's position be adjusted so the platens do not contact as soon. The platens then must contact closer to the 180° position of the crank because the distance from the glider to the end of the rigid arm remains constant throughout the dwell.

In addition to using a spacer to effectively eliminate the springs' contribution, it is sometimes desirable to alter the duration of the extended dwell without eliminating the dwell extension altogether. Such a configuration requires various size spacer bushings be inserted depending upon the desired duration. The platens must then be repositioned so they contact at the proper time in the crank's cycle.

If an extended dwell is desired and the press is in the non-extended dwell rigid mode where the springs are blocked out, the mechanical blocking device must be removed to free the glider. Because the glider's position does not change when the blocking device is removed, the transition from non-extended dwell to an extended dwell is referred to as positive action. The distance from the glider's connection to the platen to the rigid arm's connection to the crank is not altered by removing the blocking device. Therefore, the platens' position must be adjusted by the operator so that they will contact sooner.

Using the bushing spacers is cumbersome and inefficient because several steps are necessary to replace the spacers to provide the desired dwell duration. These steps typically involve removing a rod that extends from the glider through the end of the arm and provides a track for the bushing as the glider slides. The rod is held in place by screws and must be freed before removal, and once the rod is removed, the bushing can be removed as well. The desired bushing is inserted and the rod is replaced unless the bushing inserted placed the system in the rigid mode. Additionally, each time the duration of the dwell needs to be altered by changing the bushings, such as converting the system from a fully extended dwell to the rigid non-extended dwell, the platens' relative positions must be altered so that contact is established at the appropriate time in the crank's cycle.

SUMMARY

The present invention is directed to a platen press that provides a compression force by utilizing a bias member and provides adjustment of the dwell using a tensioner linked to the bias member. The bias is provided as a source for the impression force during the extended periods of contact. Using the bias permits the dwell to be extended and pressure to be applied during the initial and ending portions of the extended dwell.

One possible embodiment of the present invention is a platen press device that includes first and second platens that form the press. A driven biasing member is included to exert a biasing force. An arm that moves at least one of the platens is also included. The arm may move in opposition to the biasing force exerted by the driven biasing member once the first and second platens establish contact. The motion of the arm in opposition to the biasing force during contact creates an impression force between the first and second platens. The duration of the dwell and the initial bias force is controlled by a tensioner linked to the driven biasing member.

An alternative embodiment of the present invention is a method for operating the platen press device that has the first and second platens and the driven biasing member. The method involves establishing contact between the first and second platens. The method also involves creating an impression force between the first and second platens by transferring the bias force provided by the driven biasing member. The bias force may be transferred to the platens by moving an arm linked to the platens in opposition to the bias force once the platens have established contact. The bias force is varied by operation of a tensioner linked to the driven bias member.

DETAILED DESCRIPTION

Figure 1:
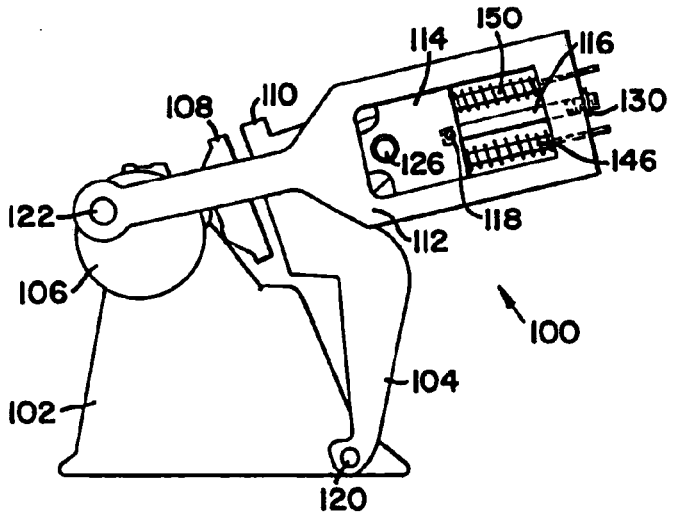
FIG. 1 is a plan view of one embodiment of a platen press.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto.

Exemplary embodiments of the present invention permit compression force between the platens of the press to be applied for more than an instant period of time and then be repetitively applied. Generating a compression force that is applied over a period of time when the platens are in contact for a given press size, allows the press to stamp materials normally reserved for a larger press capable of a higher maximum compression impulse.

Some embodiments of the present invention employ a rotational-type of driving mechanism, such as a crank, attached to an arm that is linked to the movable platen through at least an energy storage device such as a spring or hydraulic cylinder. The energy storage device permits embodiments of the present invention to achieve the extended dwell time while applying an impression force throughout the extended dwell. A tensioner is provided to adjust the duration of the dwell and automatically position the platens, using a negative action approach, when configuring the system to operate from a fully extended dwell mode to a non-extended rigid dwell mode.

Other driving mechanisms and platen configurations are possible. In some embodiments, for example, both platens might move. Yet other embodiments have a variety of different drive mechanisms and structures for driving the platens.

The embodiments described illustrate a platen press having driven bias members that employ spring or fluid biases. Some examples of a fluid bias include hydraulics as well as pneumatics. Other types of driven systems may be available as well including electromechanical systems that employ devices such as solenoids that form a part of the driven biasing member in place of the springs, hydraulics, or pneumatic system.

Though embodiments illustrated and described herein show a bias furnished by a pair of springs abutting an arm and a glider, where the glider slides on the arm and is connected to one of the platens, it should be noted that many variations of connecting these components are possible. One skilled in the art will quickly see that placement of the springs can be altered, and the glider can even be eliminated. Also, alternatives embodying the present invention may use a driven biasing member that employs hydraulics or other structures such as pneumatics for providing a fluid bias that permits creation of the impression force. Such other structures are also readily apparent to one with skill in the art.

Figure 2:
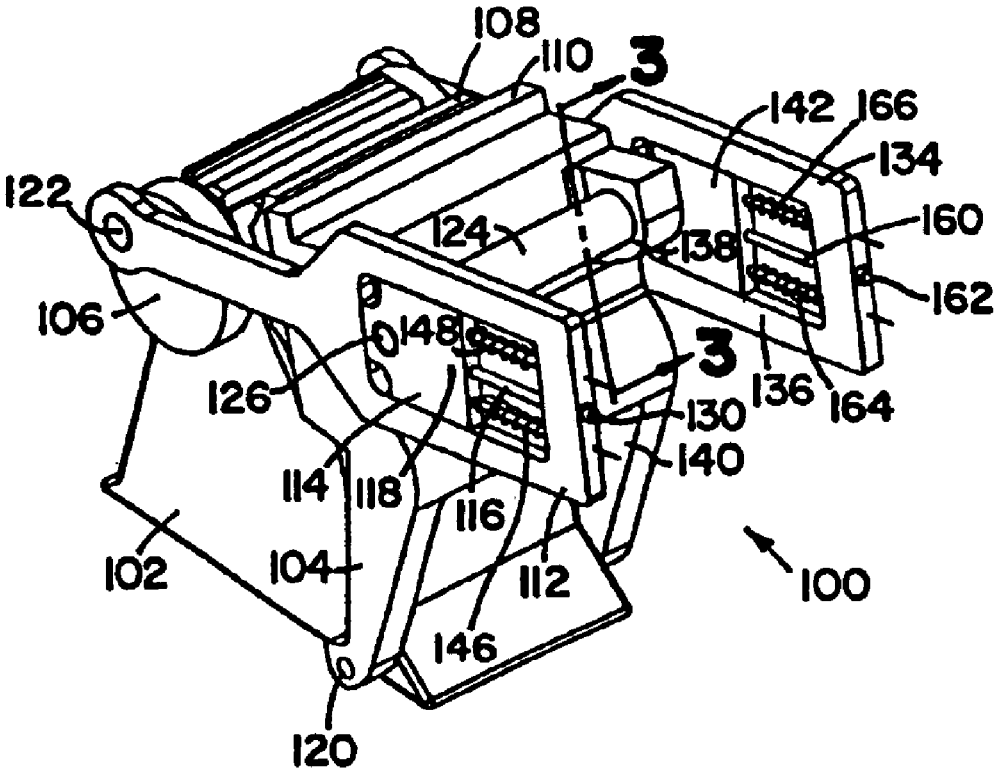
FIG. 2 is a perspective view of the platen press illustrated in FIG. 1.

FIGS. 1 and 2 illustrate one example of a platen press 100 embodying the present invention. The platen press includes a press base 102 that provides structural support for the device. A drive mechanism 106, arms 112 and 134, and driven biasing members including gliders 114, 142 and springs 146 and 148 that provide the energy necessary to generate the impression force during the extended dwell periods in this particular embodiment. A first platen 108 is attached to the press base 102 in a stationary position. Alternatively, the first platen may be movable. A second platen 110 is attached to a movable platen arm 104. The movable platen arms 104 and 140 are propelled by a connection to the gliders 114 and 142, respectively.

The driving mechanism 106 is attached to a motor (not shown). For many applications, a 3-phase electrical motor will be utilized. In one embodiment, the electrical motor drives a shaft that links both the crank forming the driving mechanism 106 and a flywheel (not shown). The flywheel helps maintain the speed of the motor throughout the impression cycle and prevents the platens from becoming locked together as the impression force peaks. Although a crank is illustrated, many other driving mechanisms can be used to drive the arm 112. Some examples of driving mechanisms include cams, toggles, cranks, and linear actuators such as hydraulic cylinders. One skilled in the art will recognize that many other driving mechanisms not specifically mentioned are possible as well.

The arms 112 and 134 transfer the kinetic energy of the driving mechanism to the movable platen 110. The arm 112 is linked to the driving mechanism 106 by joint 122, and the arm 134 is linked to another driving mechanism in the same fashion. As the driving mechanism 106 rotates, the arm 112 maintains a substantially horizontal alignment due to its connection to the platen arm 104, and provides a back and forth motion in the generally horizontal direction. Arm 134 is linked to platen arm 140 and is moved in the same manner.

This back and forth motion swings the movable platen 110 in the direction of the platen 108. As the driving mechanism 106 rotates from an initial or 0° position which is approximately a 3 o'clock position in FIG. 1, to a half revolution or 180° position, which is approximately a 9 o'clock position, the movable platen 110 establishes contact with the platen 108. As the driving mechanism 106 continues to turn toward the 180° position, the impression force increases to maximum. As the driving mechanism 106 moves past the 180° position, the arm 112 moves in the opposite direction and the impression force dissipates until the platens 108 and 110 separate. This process repeats as the driving mechanism continues to turn.

Although operation of the drive mechanism is described as reaching the maximum impression force (and range of movement for the arm 112) as the driving mechanism 106 reaches a 180° position, other configurations are possible. For example, the maximum impression force might be reached at a different angle of rotation for the driving mechanism 106. The maximum travel for the arm 112 might also be reached at different angles of rotation.

The platen arms 104 and 140 move with respect to the press base 102 so that the platens 108 and 110 may be contacted and separated as the driving mechanism 106 rotates. The platen arms 104 and 140 are shown to have a hinged connection 120 to the press base 102. However, many alternatives exist. For example, the platen arm could slide on rails (not shown) and move in a linear fashion rather than rotate.

The pressure provided between the two platens 108 and 110 as they establish contact is provided from the rigid arms 112 and through the driven biasing members which include the springs 146, 148, 164, 166 in this exemplary embodiment. Also, in the embodiment shown, the gliders 114 and 142 are provided as part of the driven biasing members to complete the transfer of force from the springs 146, 148, 164, and 166 to the platen arm 104 and movable platen 110. The gliders 114 and 142 slidably engage the arms 112 and 134 to allow the arms to continue to move once the platens 108 and 110 engage. The structure of the sliding engagement between the gliders 114, 142 and the arms 112, 134 is discussed herein with reference to FIG. 4. The gliders range of movements are controlled by their abutment against the arm 112 and dwell spacers riding on guide shafts, which are shown in greater detail in FIG. 4.

The duration of the dwell and the appropriate positioning of the platens can be efficiently controlled by operation of a tensioner linked to the gliders 114 and 142. In the embodiment shown, a tensioner is provided for each arm 112 and 134. The tensioners include studs 116 and 160 that are affixed to the glider. Typically, the stud 116 rests in a hole in the glider 114 and is held in place by a pin 118. The stud extends through a gap between the glider 114 and the end of the arm 112 and passes through a cylindrical hole in the end of the arm 112.

The stud's end extends beyond the back outer edge of the arm 112 and provides threads upon which nut 130 is tightened. Similarly for the other arm, stud 160 extends through a hole in the back of the arm 134 and provides threads upon which another nut is tightened. Operation of the stud, pin, threads and nut are described in greater detail below with reference to FIG. 4.

The gliders 114 and 142 are connected to the platen arms 104 and 140 through bearing journals 126, a backshaft 124, and backshaft receptacles 138 seen in FIG. 2. A more detailed view of the bearing journal 126, the associated backshaft 124, and the backshaft receptacles 138 can be seen in FIG. 3, and a description of additional backshaft features is also provided herein with reference to FIG. 3.

As mentioned, many alternative configurations for the driven biasing member exist and eliminate the need for the springs and/or glider. Pneumatics could be employed to provide a fluid type driven biasing member. In that case, compressible containers filled with pressurized gas could be directly connected to the second platen 110 as well as the arms 112 and 134 to provide the fluid bias between the two. Once the platens 108 and 110 engage, the arms 112 and 134 continue to move thereby compressing the containers. In this configuration, no glider is necessary and no dwell spacers are needed. The pressurized gas opposes the motion of the arms 112 and 134 and an impression force is developed between the platens 108 and 110 as a result. The tensioner including a pin, stud, and nut would be disposed alongside the pneumatic container to permit adjustment of the dwell's duration.

Alternatively, the arms 112 and 134 could be rigidly connected to the second platen 110 and the driven bias members could be used to connect the first platen 108 to the press base 102. As in the previous example, if a compressible container is used in place of the cylinders and glider, once the platens 108 and 110 engage the arms 112 and 134 continue to move thereby compressing the container. The pressurized gas again opposes the motion of the arms 112 and 134 and an impression force between the platens 108 and 110 results. The tensioner links the base 102 and the first platen 108 and permits adjustment of the dwell's duration.

Many other configurations are possible as well, and these include using any number of driven bias member combinations. For example, a fluid-driven bias member may be linked to one platen 108 and the press base 102, and a second fluid-driven bias member may be linked to the other platen 110 and the arm 112. One or both of the fluid-driven bias members may be replaced by another type of driven bias member. In each of these configurations, the driving mechanism is linked either directly or indirectly to at least one of the platens 108 and 110, and the one or more driven bias members are also linked either directly or indirectly to at least one of the platens. For one or each of the biasing members, a tensioner is provided to control the dwell's duration.

In operation, the exemplary platen press shown in FIGS. 1 and 2 functions as follows. The driving mechanism 106 continuously turns at a nearly constant angular velocity. The rigid arms 112 and 134 move back and forth in a generally horizontal direction. The horizontal movement of the rigid arms 112 and 134 are essentially sinusoidal with respect to time. As the rigid arm 112 approaches the 180° position, the platens 108 and 110 establish contact. The driving mechanism 106 continues to turn, forcing the rigid arms 112 and 134 to continue moving to the left, in opposition to the force from the springs 146, 148, 164, and 166. Because the platens 108 and 110 are already in contact, an impression force develops between them.

The springs 146, 148, 164, and 166 are initially at a baseline pressure which is the amount of pressure present when the platens 108 and 110 are separated and the springs are extended forcing the front of the glider 114 to abut the rigid arm 112. This baseline pressure may be varied depending upon the impression force characteristics desired by choosing springs with various spring constants or by adjusting the nut 130 to further compress the springs. However, adjusting the nut also varies the duration of the dwell, as will be discussed below with reference to FIG. 4.

As the driving mechanism continues to turn, the impression force begins to exceed the baseline pressure initially applied by the springs. Once the baseline pressure is less than the impression force, the gliders 114 and 142 slide relative to the arms 112 and 134 as the arms continue to move horizontally toward the driving mechanism 106 in opposition to the biasing force of the springs 146, 148, 164, and 166.

The rigid arms 112 and 134 are manufactured to have a tensile strength that exceeds the peak impression force that must be created for proper foil embossing. Once the platens 108 and 110 have established contact, the rigid arms 112 and 134 begin to experience tensile force which increases as motion of the arms 112 and 134 continues. The impression force increases as the arms 112 and 134 continue to move in opposition to the force from the springs 146, 148, 164, and 166.

Figure 3:
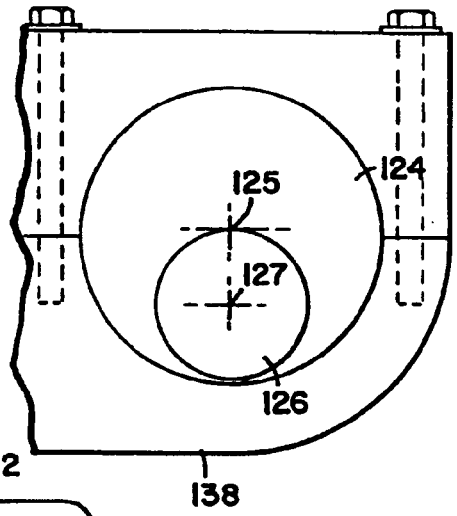
FIG. 3 is an enlarged view of the exemplary platen press embodiment's bearing journal, backshaft, and backshaft receptacle.

FIG. 3 illustrates a breakout view taken along line 3—3 of FIG. 2 for an embodiment where the backshaft 124 has an offset bearing journal 126 that links the gliders 114 and 142 to the platen arms 104 and 140, respectively. The bearing journal 126 extends into the mounting hole provided in the gliders 114 and 142. As can be seen in FIG. 3, the center point 127 of the bearing journal 126 does not align with the center point 125 of the backshaft 124 but is offset instead. The backshaft's ends are housed by the backshaft receptacles 138 that form a part of the platen arms 104 and 140. The backshaft 124 is fixed within the platen arm 104 so that impression force is not lost due to backshaft rotation during operation. However, the backshaft 124 may be freed so that it can rotate relative to the platen arm backshaft receptacles 138 when an adjustment must be made to the platen arm's position.

The backshaft method of adjusting the platens does not account for the displacement of the glider 114. Therefore, the back shaft should be rotated only to the point where the dwell spacers (discussed with reference to FIG. 4) just contact the arm 112 at the moment of peak impression force. This prevents the tensile force on the arms 112 and 134 from becoming too great.

As shown in FIG. 3, the backshaft receptacle 138 may form two pieces that surround the backshaft 124 and are held tightly to the backshaft 124 by screws that clamp the two pieces of the receptacle 138 firmly against the backshaft 124. Alternatively, screws may pass through the receptacle 138 and into holes in the backshaft 124 to fix the backshaft's position relative to the receptacle 138. Rather than providing a clamping receptacle, a cast or solid block having a bore sized to receive the backshaft 124 may be used. The backshaft's ends may be configured to match stops provided in the bore so that that the backshaft 124 can be fixed in an appropriate position for a given impression cycle by rotating the backshaft against the provided stops. The location of the stops are predetermined by methods known in the art to provide the correct platen positioning.

The platen arm's position for a given position of the rigid arm 112 can be varied by rotating the bearing journal 126 once the backshaft 124 is freed. If the backshaft 124 is freed, the bearing journal 126 may be rotated about its center point 127. This rotation causes the backshaft to also rotate about the center point 127 of the bearing journal 126 rather than the center point 125 of the backshaft 124.

Because the backshaft 124 rotates within the platen arm's receptacles and around the centerline of the bearing journal 126, the receptacle 138 is forced to move tangentially to the direction of the backshaft's rotation. The platen arms 104 and 140 connected to the backshaft 124 through the receptacles 138 are either moved closer to the other platen 108 or farther away, depending upon the direction the backshaft 124 is rotated. Once the platen arm 104 is properly repositioned, the backshaft 124 is again fixed in position relative to the platen arm's receptacles 138.

Adjusting the position of the platen arms 104 and 140 by rotating the backshaft 124 is useful in varying the duration of the impression but the dwell spacers (discussed below with reference to FIG. 4) must be resized to account for the resulting dwell duration. The closer the platen arm 104 is moved to the other platen 108, the sooner contact is established and the longer contact is maintained causing more movement of the glider 114 through the cycle and requiring shorter dwell spacers.

Adjusting the tensioner also varies the dwell and automatically sets the platens to the appropriate position to account for the glider's maximum range of movement associated with the new dwell duration. Adjusting the tensioner rather than the backshaft permits the dwell's duration to be altered without requiring alteration of the dwell spacer's lengths.

Figure 4:
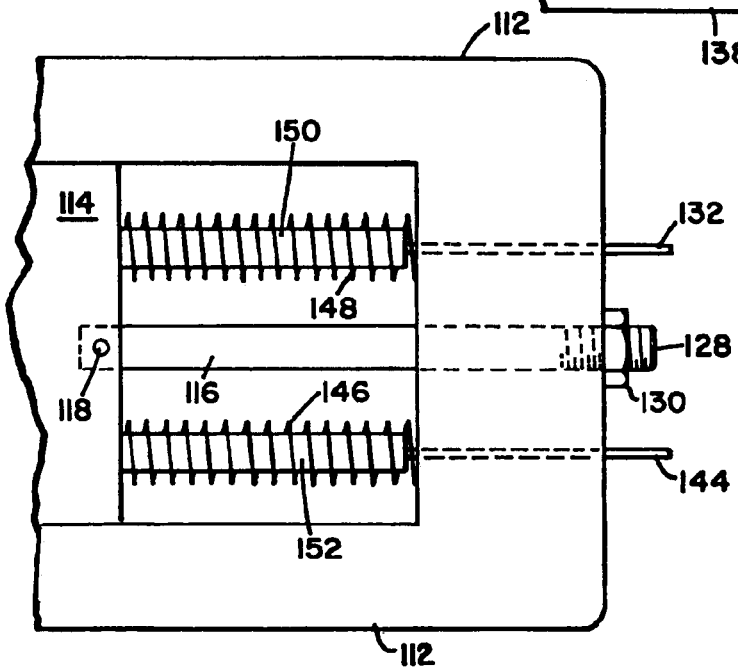
FIG. 4 is an enlarged view of the spring, stud, and pin connections to the glider and rigid arm of the exemplary platen press embodiment.

FIG. 4 illustrates the incorporation of the glider 114, the springs 146, 148, and the tensioner (stud 116, pin 118, threads 128, and nut 130 in this embodiment) into the rigid arm 112. The glider 142, springs 164, 166 and other tensioner are incorporated into the rigid arm 134 in the same manner. The glider 114 slidably engages the rigid arm 112. As shown, this engagement may require the rigid arm to be slotted so that the glider 114 fits within the slots and may slide in either linear direction relative to the arm 112, but is restricted in the other two dimensions. An alternative embodiment for the glider 114 provides the glider with slots which the rigid arm 112 fits into. The glider 114 provides the link between the arm 112 and the platen arm 104.

The range of movement of the glider 114 is controlled by the glider's abutment against the arm 112 in one direction and by dwell spacers 150 and 152 in the other direction. The dwell spacers 150 and 152 reside on guide shafts 132 and 144 that extend through holes in the end of the rigid arm 112, and through holes in the dwell spacers 150 and 152. The guide shafts 132 and 144 are affixed to the rigid arm 112 with screws. The guide shafts 132 and 144 extend through the dwell spacers 150 and 152 but terminate before reaching the glider 114. A space between the end of the guide shafts 132 and 144 must be equal to or greater than the space between the dwell spacers 150 and 152 and the rigid arm 112 to prevent the guide shafts 132 and 144 from contacting the glider 114 during the impression cycle.

The tensioner including the shaft 116, pin 118, threads 128 and nut 130 provide the flexibility for adjusting the dwell's duration. The stud 116 extends into the glider 114. A pin 118 running perpendicular to the stud's longitudinal axis passes through the glider 114 and the stud 116 to affix the stud to the glider 114. The stud 116 extends through a hole in the arm 112 and beyond the back edge of the arm 112. Threads 128 on the stud 116 accept a nut 130. The nut's position on the stud 116 controls the dwell's duration as well as the preload on the springs 146 and 148.

An alternative embodiment for the tensioner utilizes a bolt in place of the stud 116. The bolt's head abuts the rigid arm in place of the nut 130. The glider 114 has a threaded hole that receives the threads of the bolt. Turning the head of the bolt in one direction pulls the glider toward the back of the rigid arm 112 and decreases the dwell time and eliminates any dwell extension by making the system rigid when the dwell spacers 150 and 152 abut the rigid arm 112. Turning the head in the other direction allows the springs 146 and 148 to extend and permits the glider 114 to slide towards the crank 106 and the front of the rigid arm 112.

This embodiment utilizing a bolt causes the glider 114 to be susceptible to thread wear in addition to the bolt. Glider thread wear could cause eventual failure of the tensioner requiring glider 114 replacement. Therefore, the stud tensioner is preferred since thread wear and resulting tensioner failure only require replacement of the stud 116 and nut 130 and not the generally more expensive glider 114.

In the illustrated embodiment, to alter the duration of the dwell and the preload on the springs 146 and 148, the only adjustment necessary is a turn of the nut 130. The stud 116 is fixed by pin 118 and cannot rotate in response to rotation of nut 130. Thus, rotation of the nut 130 in one direction pulls the glider 114 towards the nut 130, thereby compressing the springs 146 and 148 and reducing the distance from the dwell spacers 150 and 152 to the back portion of the rigid arm 112. The glider is directly connected to the platen arm 104 and the platen arm 104 and platen 110 move in response to the turn of the nut 130 as well. Thus, an additional platen adjustment is not necessary because the adjustment of the tensioner alters the springs preload and the platens position simultaneously.

If a non-extended dwell cycle is desired, the nut 130 is tightened on the threads 128 until the dwell spacers 150 and 152 rest against the back portion of the rigid arm 112. The driven bias member is effectively removed from operation during the cycle and the press behaves in a rigid manner. The platen arm 104 becomes rigidly connected to the rigid arm 112. The dwell spacers 150 and 152 must be capable of transferring the impression force without crushing when the press is operated in the rigid mode.

When the platens are set in motion for a non-extended rigid mode dwell by movement of the driving mechanism 106, they establish contact later in the cycle and separate earlier in the cycle than if the dwell had been extended. The impression force becomes virtually an impulse due to the rigidity of the connection between the arms 112 and 134 and the platen arms 104 and 140, respectively. The platen press operates as if the platen arm 104 is directly connected to the rigid arm 112.

If an extended dwell is desired, the nut 130 is turned in the opposite direction allowing the springs 146 and 148 to extend until the glider 114 has moved to abut the front portion of the rigid arm 112. Turning the nut 130 to slide the glider 114 forward in response to the spring bias is a negative action because sliding the glider 114 forward effectively shortens the distance between connections 122 and 126. Because setting the system to the extended dwell mode involves negative action as opposed to the previously mentioned positive action for systems without tensioners, no adjustment is required to the platens' positioning because the platens will automatically establish contact sooner in the extended dwell mode. They engage sooner because the negative action adjustment pulls them closer together as the glider 114 moves forward in response to turning the nut 130 and this effect occurs without further adjustment by the operator.

When the platens are set in motion for the extended dwell, they establish contact sooner and separate later than if a non-extended dwell had been used. Once contact is made between the platens and the pressure between them exceeds the baseline amount established by the springs' preload, the glider 114 slides along the rigid arm 112 as the arm 112 continues to move. This movement of the arm 112 relative to the glider 114 causes the springs 146 and 148 to compress and force is transferred from the springs, through the glider 114 and connection 126 into the platen 110. The transfer of force results in an impression force between the platens 110 and 108 because platen 108 has a fixed position.

The driving mechanism 106 continues to rotate at approximately a constant angular velocity and the arm 112 continues to move, thereby moving the cylinder 116. The motion of the arm 112 causes the glider 114 to continue to move in opposition to the increasing resistance from the spring bias since the platens 108 and 110 are engaged and the glider 114 can no longer move with the arm 112. The rigid arm 112 experiences tension as a result because the arm's movement is opposed by the spring bias. An impression force between the platens 108 and 110 develops and increases as the arm 112 continues to move toward the driving mechanism 106 because the resistance force of the springs is transferred.

The transfer of force passes from the springs 146 and 148 through the glider 114. The glider 114 transfers the force into the bearing journal 126 which transfers the force to the backshaft 124. The backshaft 124 transfers the force to the receptacle 138, which transfers the force into the platen arm 104 and finally into the platen 110 engaged against platen 108.

As the glider 114 slides to compress the springs 146 and 148, the shaft extends further beyond the back end of the rigid arm 112. The nut 130 disengages the rigid arm 112 when the glider 112 first begins to slide and remains disengaged throughout the impression cycle until the glider 114 returns to its rest position where it abuts the front portion of rigid arm 112.

As the cycle continues after the glider 114 first begins to move, eventually the impression force peaks as the dwell spacers abut both the glider 114 and the rigid arm 112 causing the system to become momentarily rigid. Then, the force begins to lessen as the rigid arm begins to move in the opposite direction. The glider slides along the rigid arm 112 as the arm 112 moves away from the driving mechanism 106 because pressure is being applied to the glider 114 by the spring bias.

During motion of the arm 112 relative to the glider 114, the impression force is maintained because the spring bias is continually provided as the springs 146 and 148 extend. The springs 146 and 148 bias the glider 114 toward the driving mechanism 106 as the rigid arm 112 moves. Finally, the rigid arm 112 has moved far enough in the direction away from the driving mechanism 106 to cause the glider 114 to reach the stop provided in the rigid arm 112. At that point, the platens 108 and 110 separate as the rigid arm 112 continues to move in the direction away from the driving mechanism 106.

The parameters used in configuring the press for a specific job are determined by the amount and type of foil that will be used, the type of media that will be printed upon, and whether embossing will be done. In a typical configuration, two springs per rigid arm are used and each spring has a maximum force of about 1200 pounds. During the impression cycle, a typical glider 114, dwell spacer, and tensioner configuration results in a 0.25 inch lateral movement of the glider 114 relative to the arm 112. At a typical operating speed of 3000 impression cycles per hour, this displacement occurs within 61 milliseconds.

The impression force provided by the springs 146 and 148 and then the rigid arm 112 at the impulse point is distributed throughout the area of the image being pressed, so the resulting image pressure is dependent upon the image's dimensions. In a typical configuration, the dimensions of the platens 108 and 110 themselves are about fourteen inches of width and about twenty two inches of length resulting in an area of approximately 308 square inches.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

What is claimed is:

1. A platen press device comprising:

first and second platens cooperatively opposed to each other forming a press;

a drive mechanism that is coupled to at least one of the platens, the drive mechanism generating a cyclical impression force that presses the first and second platens together during a dwell;

a driven biasing member coupled to one of the platens, the driven biasing member further urging the one of the platens toward the other platen; and a tensioner linked to the driven biasing member, the tensioner arranged to adjust the dwell.

2. The platen press of claim 1, further comprising an arm that links the drive mechanism to the at least one platen, wherein the driven biasing member movably engages the arm, and wherein the tensioner comprises a stud and nut, the stud being affixed to the driven biasing member and the nut threadedly engages the stud and abuts the arm.

3. The platen press of claim 2, wherein a portion of the driven biasing member is rigidly connected to the second platen, and wherein the portion of the driven biasing member moves with respect to the arm once the first and second platens establish contact.

4. The platen press of claim 3, wherein the driven biasing member may be selectively fixed relative to the arm for a rigid operation and a relative separation of the platens may be altered by threaded rotation of the nut about the stud.

5. The platen press of claim 1, wherein the driven biasing member is a spring driven biasing member comprising a spring about a guide shaft and a dwell spacer, the spring providing a bias force, the press further comprising an arm linked to the driving mechanism and the at least one platen, and wherein the arm moves in opposition to the bias force when the platens establish contact.

6. The platen press of claim 5, wherein the spring driven biasing member further comprises a glider slidably engaging the arm and fixed to the dwell spacer and at least one of the platens, and wherein the tensioner comprises a stud affixed to the glider an a nut threadedly engaging the stud and abutting the arm.

7. The platen press device of claim 6, further comprising:

a backshaft having at least one offset bearing journal extending from one end, the bearing journal being connected to the glider and the backshaft being connected to the at least one platen; and wherein a position of the at least one platen is variable by rotation of the backshaft about a centerline of the offset bearing journal.

8. The platen press of claim 2, wherein the driven biasing member is a fluid-driven biasing member comprising a hydraulic cylinder, and a glider movably linked to the arm, wherein the hydraulic cylinder exerts a bias force on the glider, and wherein the glider's position relative to the arm is selectively fixed and a relative separation of the platens is altered for a rigid operation by threaded rotation of the nut about the stud.

9. The platen press of claim 1 wherein the tensioner adjusts the dwell by adjusting the amount of force exerted between the first and second platens by the biasing member.

10. The platen press of claim 1 wherein the tensioner adjusts the dwell by adjusting the duration of the dwell.

11. The platen press of claim 1 wherein the tensioner adjusts the position of one of the platens relative to the other platen when the platens are not pressed together.

12. The platen press of claim 1 further comprising a drive arm that is coupled between the drive mechanism and the at least one platen, the driven biasing member comprising a glider that movably engages the drive arm, the glider also being coupled to the at least one platen to link the drive arm to the at least one platen, wherein the glider moves with respect to the drive arm once the first and second platens establish contact.

13. The platen press of claim 12 wherein the tensioner adjusts the position of the at least one platen relative to the drive arm.

14. The platen press of claim 12 wherein the tensioner adjusts the position of the glider relative to the drive arm.

15. A platen press comprising:

a drive system comprising a drive arm;

a glider that is slidably coupled to the drive arm;

a biasing apparatus that is coupled to the glider and the drive arm, the biasing apparatus applying a biasing force to the glider;

a platen system comprising at least two platens that are configured to compress a target material between the platens when the platens are pressed together, at least one of the platens being coupled to the glider; and an adjustment mechanism that is coupled to the glider and configured to adjust the position of the glider relative to the arm.

16. The platen press of claim 15 wherein adjusting the position of the glider adjusts the duration of a dwell during which the platens are pressed together.

17. The platen press of claim 15 wherein the biasing apparatus comprises at least one spring, the spring exerting a spring force on the glider, and during at least a portion of a dwell the spring force is transferred through the glider to the platen to generate an impression force on a target material between the platens.

18. The platen press of claim 17 wherein the adjustment mechanism comprises a member having a first end and a second end, the first end being affixed to the glider and the second end passing through the drive arm, the second end comprising threads and a nut that is engaged on the threads, the nut being configured to limit the motion of the glider.

19. The platen press of claim 18 wherein the position of the glider relative to the arm may be adjusted by turning the nut.

20. The platen press of claim 19 wherein adjusting the position of the glider adjusts the force exerted by the spring on the glider.

21. The platen press of claim 20 wherein adjusting the position of the glider adjusts the duration of time during which the platens are pressed together.

* * * * *